United States Patent [19]

Holl et al.

[11] Patent Number: 5,025,724

[45] Date of Patent: Jun. 25, 1991

[54] CHANGE-OVER DEVICE FOR AN INTERMEDIATE DAMPING ROLLER IN AN OFFSET PRINTING PRESS

[75] Inventors: Roland Holl, Weiterstadt; Peter Hummel, Offenbach am Main; Herbert Rebel, Rodgau, all of Fed. Rep. of Germany

[73] Assignee: MAN Roland Druckmaschinen AG, Fed. Rep. of Germany

[21] Appl. No.: 491,507

[22] Filed: Mar. 12, 1990

[30] Foreign Application Priority Data

Mar. 13, 1989 [DE] Fed. Rep. of Germany ..... 3908043

[51] Int. Cl.[5] ..... B41F 7/26; B41F 7/36; B41F 7/40; B41L 25/16

[52] U.S. Cl. ..... 101/148; 101/352

[58] Field of Search ..... 101/148, 147, 349, 351, 101/352, 207, 208, 209, 210, 247, 132.5, 136, 141, 140, 144; 118/256, 258

[56] References Cited

U.S. PATENT DOCUMENTS 3,559,569 2/1971 Jurny ..... 101/148
3,911,815 10/1975 Banfer ..... 101/148
4,440,081 4/1984 Beisel ..... 101/148

FOREIGN PATENT DOCUMENTS 1932642 of 0000 Fed. Rep. of Germany .
3637460 of 0000 Fed. Rep. of Germany .

*Primary Examiner*—J. Reed Fisher
*Attorney, Agent, or Firm*—Leydig, Voit & Mayer

[57] ABSTRACT

To enable two intermediate rollers to be selectively associated with a combined damping and inking unit as connecting rollers, or with the applicator roller of the damping unit as a first rider roller and a tandem second rider roller, the spindle of the second intermediate roller is removably received at both ends, a bearing lever pivotable around the axis of the first ink spreader roller. Also, swing levers are pivotally connected, one at each end, to the spindle of the first intermediate roller and each swing lever has guides for guiding the second intermediate roller between its first position as a connecting roller and its second position as a tandem roller laterally below the first intermediate roller and in engagement with the applicator roller of the damping unit.

7 Claims, 2 Drawing Sheets

CHANGE-OVER DEVICE FOR AN INTERMEDIATE DAMPING ROLLER IN AN OFFSET PRINTING PRESS

FIELD OF THE INVENTION

The present invention relates generally to a device in offset printing presses for changing over the second intermediate roller of an intermediate roller pair connecting an inking unit to a damping unit, and more particularly concerns a device for repositioning the intermediate roller as a tandem rider roller in the damping unit.

BACKGROUND OF THE INVENTION

It is known from DE-BM 1,932,642 to dispose, between the final damping roller of a damping unit and the first inking roller of the inking unit, either a single intermediate roller or, if the final damping roller is, for example, too far away from the first inking roller, two or more intermediate rollers in consecutive relationship and to engage the intermediate rollers with an inking or damping spreader roller.

The use of an intermediate roller pair is already known from a research report No. 3,216 "Damping Device" of the German Research Society for Printing and Reproduction Technology (FOGRA), at page 30, FIG. 38. Here, both damping liquid and ink are applied to the plate cylinder by way of the applicator rollers of the damping unit. This kind of operation is satisfactory for many printing jobs, for example, in the case of thickly coated subjects which do not tend to mottle.

It is also known from DE 3,637,460 to engage a first rider roller and, as an over-rider or tandem roller, a second rider roller with a common applicator roller of a damping unit in order to reduce, by rolling of the rider roller on the applicator roller, the excess of damping agent which is due to the blank part of the plate cylinder and which may of course leave unwanted streaks on the end product.

OBJECTS AND SUMMARY OF THE INVENTION

It is the primary object of the invention to provide a change-over device whereby two intermediate rollers can, at the operator's choice, be associated with a combined damping and inking unit as connecting rollers, or with the applicator roller of the damping unit as a first rider roller and a second over-rider roller or tandem roller, with the further option in this roll position of introducing a third intermediate roller into the bearing socket of the second intermediate roller, which has been changed over as a tandem roller in engagement with the damping roller, as an additional connecting roller for the inking unit in contact with the non-changed-over first intermediate roller.

In carrying out the invention and to enable two intermediate rollers to be selectively associated with a combined damping and inking unit as connecting rollers, or with the applicator roller of the damping unit as a first rider roller and a tandem second rider roller, the spindle of the second intermediate roller is removably received at both ends in a bearing lever pivotable around the axis of the first ink spreader roller. Also, swing levers are pivotally connected, one at each end, to the spindle of the first intermediate roller and each swing lever has guides for guiding the second intermediate roller between its first position as a connecting roller and its second position as a tandem roller away from the first intermediate roller and in engagement with the applicator roller of the damping unit. The means for guiding the pivotal movement of the swing levers includes a sleeve mounted coaxially on each end of the spindle of the first intermediate roller and a slot defined in the cooperating end of each of the swing levers dimensioned so that the end of the slot engages the surface of the sleeve when the pair of intermediate rollers are disposed in contact with one another.

When the intermediate rollers are in their first position as connecting rollers between the damping unit and the inking unit, the device has four nips in relation to the first inking roller and the top intermediate roller is effective as a storage roller and smoothing roller on the first ink spreader roller. In the second setting, in which the intermediate rollers both engage the damping roller, because of the separation of the damping unit from the inking unit, the two rider rollers on the damping roller can control mottling caused by the blank parts of the plate cylinder. When a third intermediate roller is introduced into the bearing socket of the top intermediate roller, communication between the inking unit and the damping unit is restored without impairment of the operation of the tandem roller. The latter setting leads to very rapid achievement of equilibrium between the ink and the damping agent and is also a highly effective measure against mottling in both the inking unit and the damping unit.

These and other features and advantages of the invention will be more readily apparent upon reading the following description of a preferred exemplified embodiment of the invention and upon reference to the accompanying drawings wherein:

Figure 1:
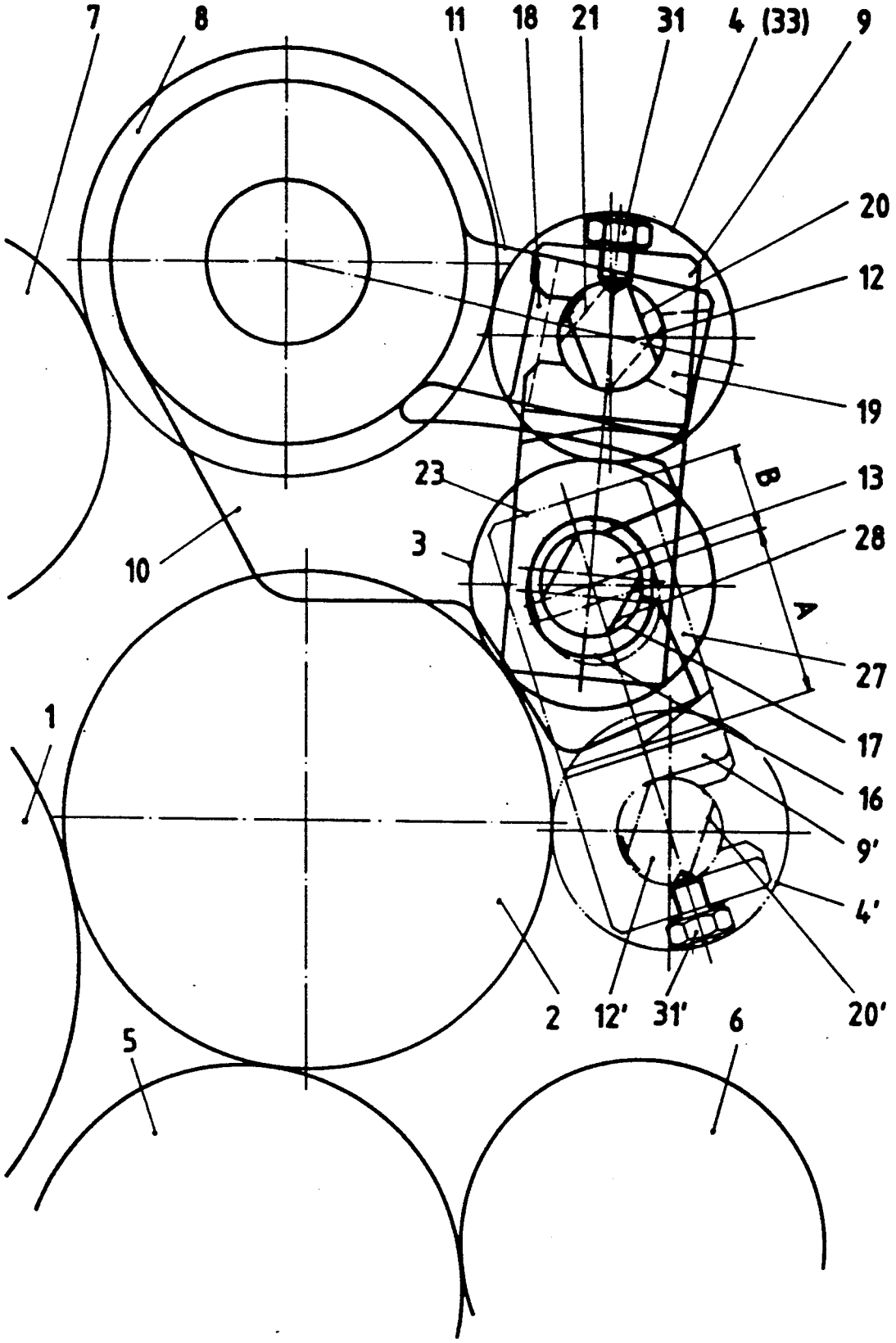
FIG. 1 is a somewhat schematic view in side elevation of a combined damping and inking unit of a printing press having the change-over device according to the present invention.
Figure 2:
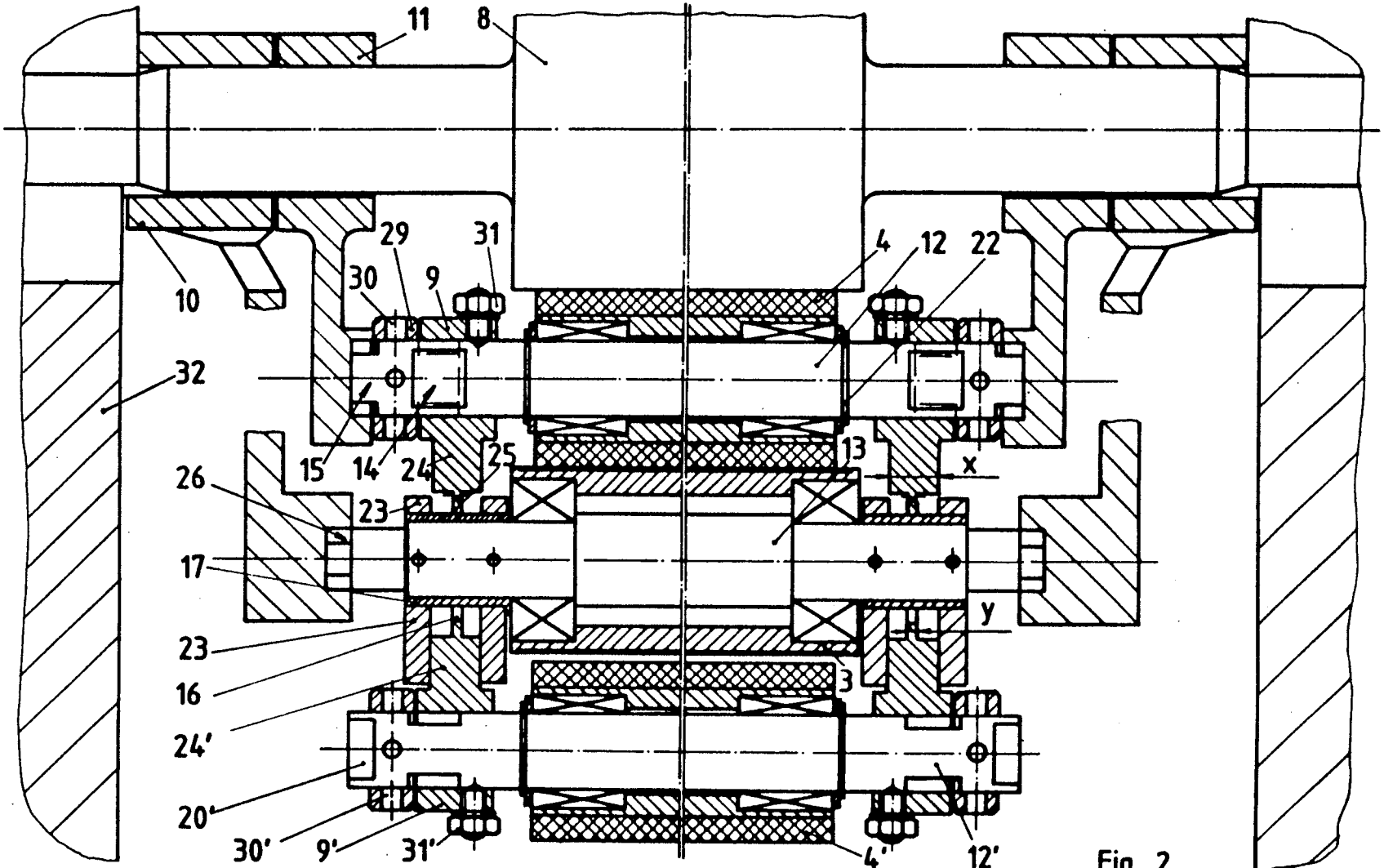
FIG. 2 is a front elevation view, partly in section, of the combined damping and inking unit of FIG. 1, further illustrating the change-over device according to the present invention.

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENTS

Turning now to the drawings, a portion of a printing press is shown in somewhat schematic fashion. The device illustrated comprises a plate cylinder 1 mounted by means of journals at each end in the side walls 32 of a printing press. In a manner which is known, and not further shown here, the journals are driven by gearwheels which are disposed outside the side walls 32 and which are, in turn, driven by the main drive of the press. Damping liquid is supplied from a water box (not shown) into which a water box roller 5 dips. The thickness of the damping liquid is adjusted by means of a dispensing roller 6 in accordance with conventional practice.

The liquid damping unit including rollers 2, 5 and 6, therefore guides the damping liquid directly on to the plate on the cylinder 1 over a very short path, thus ensuring that evaporation of the damping agent is reduced. The drive of the damping unit rollers and inking unit rollers is known and will not be further described. All the damping unit rollers 2, 5 and 6 and the intermediate rollers 3 and 4 between the damping unit and the inking unit are adjustable relatively to one another and the adjustment can in known manner take the form, for example, of the rollers being mounted on adjustable eccentric sleeves or of arranging adjusting screws and/or of the provision of springs or of bearing levers which receive the rolls.

Similar considerations apply to the necessary. shutdown of printing or night stop of the rollers and appropriate means are provided for separating the rollers from one another. Appropriate means for this purpose are familiar and are present in this device but will not be described further since they do not form part of the present invention.

In the device according to the invention, the journal at each end of the ink spreader roller 8, which engages a first ink application roller 7, and which is first as considered in the direction of plate cylinder rotation, has mounted on it a bearing lever 10 which is pivotable around the center of the roller 8 and which bears axially, for example, on the press side walls 32. The other end of the lever 10 receives the end of the spindle 13 of the first intermediate roller 3, through the agency of a roller lock 26, in a bearing socket which is open on one side. In the illustrated device, the bearing lock 26 takes the form of a part 28 of the spindle 13 flattened on its opposite sides and adapted to be introduced through a slot 27 into the bearing socket of the lever 10. The spindle 13 is secured in the bearing socket by being turned so that the flattened portions are not in alignment with the slot 27. Preferably, the roll shell of the first intermediate roller 3 is rotatably mounted on the spindle 13 with the interposition of rolling bearing means as is well known in the art.

Internally and adjacent to the bearing lever 10, a bearing lever 11 pivotable around the center of the ink spreader roller 8 is mounted at each end thereof on its journal with axial support. The other end of the lever 11 receives the end of the spindle 12 of the second intermediate roller 4, with the interposition of a roller or bearing lock 15, in a bearing socket open on one side. The bearing lock 15 is, as in the previous case, embodied by a part 21 of spindle 12 flattened on two sides and being introducible through a slot 19 into the bearing socket. The spindle 12 is turned to secure both itself and the second intermediate roller 4 in the bearing socket of the lever 11. Preferably the shell of the second intermediate roller 4 is also rotatably mounted on the spindle 12 with the interposition of rolling bearing means as is well known.

In further accordance with the invention, swing levers 9 are pivotally connected, one near each end face of the first intermediate roller 3, on a coaxial sleeve 17 on a part of the spindle 13 of the first intermediate roller 3. Each lever 9 receives the top intermediate roller 4 at its top end in a bearing socket which is open on one side, with the interposition of a roller lock 14. The roller lock 14 takes the form of a part 20 of the spindle 12 flattened on two sides and being introducible through a slot 18 into the bearing socket. The slots 18 and 19 and the corresponding flattened parts 20 and 21 are angularly offset from one another so that the spindle 12 when released from the lever 11 still remains locked in the lever 9 so that the second intermediate roller 4 can be changed over, but only when the same is in its changed-over position can it be unlocked and, therefore, removed by being turned after the release of a pressing element, such as a set screw 31. The set screw 31 also secures the lever 9 on the spindle 12 when the roller lock 15 is engaged.

To facilitate locking and unlocking the spindle 12 by rotating the same, an adjusting ring 29, which is pinned to the spindle 12 and which is formed with a bore 30, is disposed between the levers 9 and 11. Additionally, when the second intermediate roller 4 is in the first position, interconnecting the inking unit and damping unit, the axial position of the levers 10 and 11 is fixed relatively to the press side walls 32.

To change over the second intermediate roller 4—i.e., to separate the inking unit and damping unit from one another—the roller lock 15 is opened by turning the spindle 12 through approximately 90° so as to unlock the second intermediate roller 4. The lever 9 has guide means 16 and 17, in the form of a coaxial sleeve 17 on a part of the spindle 13 and of a slot 16 in the lever 9 so positioned and dimensioned that, when the intermediate rollers 3 and 4 are in contact with one another, the top bearing or contact surface of the slot 16 is disposed on the sleeve 17. Also, the sleeve 17 is effective as an axial spacing or securing sleeve for the inner races (indicated diagrammatically in the drawings by a cross) of the rolling bearings of the first intermediate roller 3 on the spindle 13. Securing rings 22 provide corresponding axial securing of the rolling bearings of the second intermediate roller 4.

By means of the guide means 16 and 17, the second intermediate roller 4 can be moved, either manually or possibly by other adjusting means (not shown) from the first position, in which it engages the bottom intermediate roller 3 and the first ink spreader roller 8, into a second position, in which the inking unit is separated from the damping unit and the second intermediate roller 4' is engaged as an over-rider or tandem roller, with separation between the intermediate rollers 3 and 4. In this position, the second intermediate roller 4' as well as the first intermediate roller 3 engage the applicator roller 2 of the damping unit.

In the drawings, the references relating to the second position of the second intermediate roller 4' and its associated parts each have been designated with a prime character.

Axial support of the lever 9' in the second position of the roller 4' is effected by coupling surfaces of two radial coupling parts 23, such surfaces being engaged by coupling surfaces of a wide web 24' of lever 9' when the roller 4' has, as a tandem roller, been lowered to engage laterally with the damping roller 2. Near the slot 16 the lever 9 has a narrow web 25 which is shown having a thickness Y while the considerably wider web 24 into which the web 25 merges towards the roller 4 is shown having a thickness X.

Pursuant to another feature of the invention the coupling parts 23 are pinned to the spindle 13 at a spacing just greater than X from one another. The lever 9 therefore slides around the center of the spindle 13 during the change-over to engage the roller 2 with guidance by the elements 17 and 16, in an accurate fit between the coupling surfaces of the parts 23 and is therefore given accurate axial support.

The two radial coupling parts 23 have a long part A and a short part B with respect to the center of the spindle 13. When the second intermediate roller 4 is in the position interconnecting the damping and inking units, the narrow web 25 of the lever 9 moves between the coupling parts 23 into their part B. When the second intermediate roller 4 changed over into the over-rider tandem position 4', the wider web 24 moves in an accurate fit between the long parts A of the coupling parts 23.

In the latter position, a uniform rolling of the surfaces of the rollers 3 and 4 on the common damping roller 2, is provided so that mottling, which is caused separately from the inking unit, due to blank parts of the plate cylinder, can be effectively cleared on the damping roller 2.

In further keeping with the invention, when the two rolls 3, 4' are in the tandem position, a connection between the inking unit and the damping unit can be restored by means of a third intermediate roller 33 placed in the bearing lever 11 and in the position of the second intermediate roller 4 without the second intermediate roller 4' having to be pivoted back to its initial position.

The third roller 33 is received in the damping unit in a parking position between the press side walls 32 and is changed only when used in the lever 11 for the changed-over second intermediate roller 4. The roller 33 is not provided with a connection to the lever 9 on the spindle 13 since it merely needs to be removed from the roller lock 15 for parking in the damping unit when it is not required to be used.

We claim as our invention:

1. A device for changing over the top intermediate roller of an intermediate roller pair connecting an inking unit to a damping unit in an offset printing press comprising:

a press frame, a plate cylinder, an inking unit including an ink spreader roller for inking said plate cylinder, a damping unit including a damping roller for damping said plate cylinder, means for mounting said plate cylinder and said inking and damping units on said press frame, a first intermediate roller having a spindle with opposed ends, a second intermediate roller having a spindle with opposed ends, a pair of first bearing levers pivotable around the center of said ink spreader roller and which bear axially against said press frame, each end of said first intermediate roller spindle being received at an end of one of said bearing levers, a pair of second bearing levers pivotable around the end of said ink spreader roller and which bear axially against said first bearing levers, p1 each end of said second intermediate roller spindle being received in the end of one of said second bearing levers, first lock means for securing each end of said second intermediate roller spindle to said second bearing levers, means including a pair of swing levers each having one end pivotally connected at one end of said first intermediate roller spindle and having another end for receiving said second intermediate roller spindle, second lock means for securing each end of said second intermediate roller spindle to said swing levers, said swing levers having guide means for guiding said second intermediate roller between a first position, in which it is in engagement with said first intermediate roller and with said ink spreader roller, and a second position, in which said second intermediate roller is pivoted away from said first intermediate roller and together therewith engages, as a tandem rider roller, with said damping roller.

2. A device according to claim 8 wherein the means for guiding the pivotal movement of the swing levers includes a sleeve mounted coaxially on each end of the spindle of the first intermediate roller and a slot defined in a cooperating end of each of the swing levers dimensioned so that an end of the slot engages a surface of the sleeve when the pair of intermediate rollers are disposed in contact with one another.

3. A device according to claim 8 wherein the first lock means includes a first spindle socket having a radially opening slot formed in the end of each of the second bearing levers pivotable around the center of the first ink spreader roller, the ends of the spindle of the second intermediate roller are formed with oppositely disposed flattened portions dimensioned for removable insertion in the slots, and the spindle ends of the second intermediate roller being retained in the first sockets when the spindle is rotated so that the flattened portions are not in alignment with the slots.

4. A device according to claim 3 wherein the second lock means includes a second spindle socket having a separate radially opening slot formed in the other end of each of the swing levers pivotal around the spindle of the first intermediate roller, the ends of the spindle of the second intermediate roller are formed with separate oppositely disposed flattened portions dimensioned for removable insertion in the separate slots, and the spindle ends of the second intermediate roller being retained in the second sockets when the spindle is rotated so that the separate flattened portions are not in alignment with the separate slots.

5. A device according to claim 4 wherein means are provided for locking the spindle of the second intermediate roller against rotation relative to the first and second spindle sockets.

6. A device according to claim 5 wherein the spindle of the second intermediate roller is releasable and removable from the first spindle socket while being retained in the second spindle socket and swung down into the second position as a tandem rider roller.

7. A device according to claim 6 including a third intermediate roller having a spindle dimensioned for reception in the first spindle socket when the spindle of the second intermediate roller is removed therefrom.

* * * * *